United States Patent [19]

Loy

[11] Patent Number: 4,743,799

[45] Date of Patent: May 10, 1988

[54] LOW PRESSURE ARC DISCHARGE LIGHT SOURCE UNIT

[75] Inventor: Helmut M. Loy, Nuremberg, Fed. Rep. of Germany

[73] Assignee: GTE Products Corporation, Danvers, Mass.

[21] Appl. No.: 929,298

[22] Filed: Nov. 10, 1986

[30] Foreign Application Priority Data

Nov. 21, 1985 [EP] European Pat. Off. ..... 85114813.0

[51] Int. Cl.[4] ..... H01J 1/62; H01J 63/04

[52] U.S. Cl. ..... 313/493; 313/610

[58] Field of Search.....313/492, 493, 610

[56] References Cited

U.S. PATENT DOCUMENTS

| | | | |
|---|---|---|---|
| 3,508,103 | 4/1970 | Young | 313/109 |
| 3,551,736 | 12/1970 | Doehner | 313/493 |
| 4,594,527 | 1/1986 | Genovese | 313/493 |
| 4,665,341 | 5/1987 | Imamura et al. | 313/493 |

FOREIGN PATENT DOCUMENTS

| | | | |
|---|---|---|---|
| 2952535 | 7/1980 | Fed. Rep. of Germany . | |
| 2549640 | 1/1985 | France . | |
| 0061756 | 5/1981 | Japan | 313/493 |
| 57-180067 | 11/1982 | Japan . | |
| 59-127357 | 7/1984 | Japan . | |

*Primary Examiner*—Theodore M. Blum

*Attorney, Agent, or Firm*—Carlo S. Bessone

[57] ABSTRACT

In a low pressure arc discharge light source unit for unipolar or bipolar operation comprising a vacuum-tight glass envelope translucent at at least one side thereof, a rare fill gas and a quantity of mercury therein, a coating of fluorescent phosphor on the inner side of the envelope, and at least two electrodes opposed to each other within the envelope and connected to electrical conductors, the envelope is flat and essentially two-dimensional comprising two planar areas essentially parallel to each other at a small distance. The unit provides for better light output, better radiation efficacy and simpler and less costly manufacture, at the same time being most compact. At least 50% of the radiation of the planar area of the front of the envelope is effective. Means are provided allowing a single cathode to cooperate with a multiplicity of anodes in e.g., a pixel.

12 Claims, 5 Drawing Sheets

Fig. 29
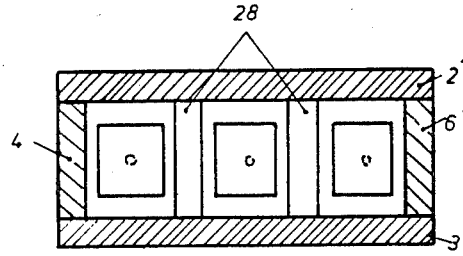
Fig. 31
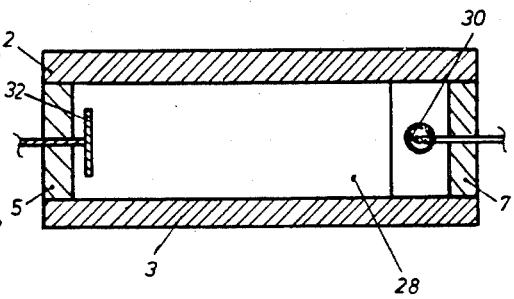
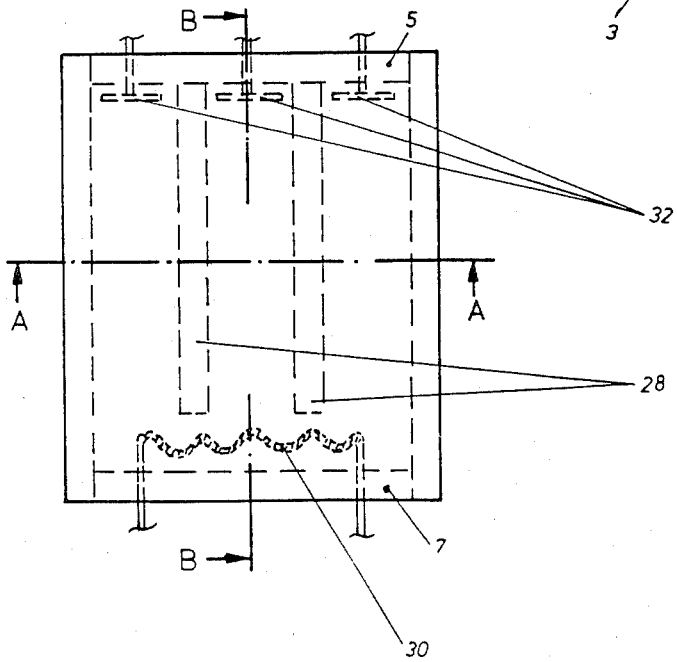
Fig. 30

LOW PRESSURE ARC DISCHARGE LIGHT SOURCE UNIT

TECHNICAL FIELD

The invention relates to a low pressure arc discharge light source unit comprising a vacuum-tight glass envelope translucent at at least one side thereof, a rare fill gas and a quantity of mercury therein, a coating of fluorescent phosphor on the inner side of the envelope, and two electrodes opposed to each other within the envelope and connected to electrical conductors, such as lead-in wires or the like.

BACKGROUND OF THE INVENTION

A light source unit of this kind for unipolar operation is known and comprises a U-shaped envelope made from glass tube material and having two parallel legs ending in sockets providing for connecting pins. The known unit can be used for optical presentation of information, i.e., presentation of alpha numeric signs, graphics and pictures displayed on a screen or display, respectively. Such a display consists of a matrix of picture elements, each picture element consisting of a monochrome light signal source in case of a monochrome display. In case of color presentation of information, one picture element is composed of three single light source units of the primary colors red, green and blue forming a so-called pixel. The desired or required, respectively, color impression is then created physiologically by additive mixture of the three primary colors within the human eye/brain system.

Presenting information to a large audience in the open air means looking for a correspondingly large area display which is distinctly visible not only at night but also during day light and with sufficient optical resolution from a greater viewing distance. In case of presentation of rapidly moving pictures, like in television, the picture information changes up to 100 times per second (and up to 120 times per second in the U.S.). At the same time the temperature of the outside environment can fluctuate over a wide range, e.g., −20° to +50° C.

While the known light source unit is able to fulfill the demands stipulated above, there are some drawbacks present:

1. The known light source unit is presenting towards the audience the curved portion of the U-shaped envelope only so that no more than approximately 20% of the radiation is effective. The rest is dissipating, especially through the parallel legs of the U-shaped envelope which are arranged substantially normal or perpendicular, respectively, to the plane of fixation of a unit, said plane being also substantially normal to the viewing direction of the spectators.

2. The production costs are relatively high in view of special workmanship and single manufacture of each unit being necessary, including application of the sockets by hand.

SUMMARY OF THE INVENTION

The object underlying the invention is to be seen in the provision of a low pressure arc discharge light source unit as mentioned above rendering better light output or intensity or brightness, respectively, enhancing overall radiation efficacy and presenting a more compact unit which can be manufactured simpler.

This object is achieved with a low pressure arc discharge light source unit elucidated above in that the envelope is flat and essentially two-dimentional comprising two planar areas essentially parallel to each other at a small distance.

This inventive configuration of the glass envelope provides for a number of advantages:

1. At least 50% of radiation of the planar area representing the front of the envelope is effective. It is to be understood that this percentage can be further increased by providing a reflective layer on the back, whether within or outside the envelope.

2. The light source unit in accordance with the invention can be manufactured at decreased cost and in a continuous manner, e.g., by use of a belt feed furnace for combining the two planar envelope areas essentially parallel to each other at a small distance, whereby the lead-in wires can be melted in. There is no need for the bending of a glass tube and for fixing sockets to the ends thereof.

The envelope of the light source unit in accordance with the invention may comprise two planar bodies of glass being fixed to each other by spacers and glass solder.

In a further embodiment the envelope comprises a planar glass body and a trough shaped glass body having a planar area and a rim, both bodies bonded to each other along the rim of the trough-shaped body by glass solder. A still further embodiment is characterized in that the envelope comprises two trough-shaped glass bodies having planar areas and rims, both bodies bonded together along their rims by glass solder.

It is preferred that there is a distance of approximately 3 mm to 10 mm between planar bodies or a planar body and the planar area of a trough-shaped body or the planar areas of two trough-shaped bodies.

The trough-shaped bodies can be cover glasses whereas the planar bodies can be made from float glass.

In a preferred embodiment on at least one of the inner sides of the planar area there is a fluorescent phosphor coating whereas on the inner or outer side of the opposite planar area there is a reflective coating so that the light output, as mentioned above, can be reinforced for unidirectional viewing. Without any reflective layer viewing will be bidirectional, of course.

It is to be understood that the general shape of the envelope can be rectangular, square, circular or even polygonal as desired. In forming the envelope, the use of float glass plates is proper with spacers or a spacer frame. Also one glass plate and a flat cover glass or sinter glass as a trough shaped body could be used, even two cover glasses. For effecting the joints, glass solder of a low-melting point of similar thermal expansion coefficient is preferred.

The leads or electrode connectors, respectively, can be made of wire or ribbon or can be formed by thin or thick film layers and fed either laterally or from the rear through the envelope, preferably single-ended.

In accordance with a preferred embodiment of the invention one or more separating walls are provided within the envelope between the planar bodies or the planar areas, respectively, said wall or walls extending essentially perpendicular thereto and in parallel relationship to each other in case of a rectangular unit. Those separating walls can be of different configuration, e.g., at least one separating wall within an envelope can extend at both ends up to and sealingly join with the spacer or the rim or the rims of the envelope to form different discharge spaces. There can be more than one separating wall, of course, e.g., two walls providing for three different discharge spaces. Each discharge space being provided with electrodes, different and independent control is possible. In a preferred embodiment the different discharge spaces are provided with fluorescent phosphors of different spectral power distribution so that different colors can be produced in the manner described above dependent from the phosphors and the energy input used, and this can be accomplished in a very advantageous manner by one single light source unit comprising only one flat and essentially two-dimensional envelope in accordance with the invention.

In accordance with a further and preferred embodiment at least one separating wall within the envelope can extend up to and join with the spacer or the rim or the rims of the envelope with only one end thereof whereas the other end keeps a distance from the spacer or the rim or the rims. By doing so one can provide for discharge spaces having multiple arc length and/or for discharge spaces allowing a common electrode. So the arc can turn around the spacer at the end thereof keeping a distance from the spacer or rim so that double arc length is provided within a single light source unit if one separating wall is present in a single-ended configuration, the wall separating the electrodes from each other at the end thereof joining with the spacer or rim of the envelope at the opposite end of the separating wall. Two separating walls and more can be provided in an opposed arrangement for multiple arc length, more specifically, the separating walls within the envelope in parallel relationship to each other can force the arc into a zig-zag-configuration. Two separating walls of this kind means triple the arc length with a double-ended light source unit. Various configurations are possible within one and the same unit, all of the discharge spaces being independently controllable. Longer discharge spaces provide for better efficacy, of course.

For unipolar operation a recessed space for the cathode can be provide so that the effective discharge length or the positive column of discharge, respectively, will be 100% within the area of the phosphor layer whereas the dark space present near the cathode is outside of the effective area of the light source, hence a better yield of the visible area of the light source unit in accordance with the invention is obtainable and advantageous especially when the unit is used for display purposes.

An aspect of the invention of special importance is the possibility to save material and labour in connection with using a common cathode, at the same time providing for better performance of the light source unit. As an example, if two separating walls are provided within a light source unit, the two separating walls providing for three discharge spaces and separating three anodes from each other, however, not extending up to opposite sides but keeping a distance from the opposite spacer or rim, one common cathode will be sufficient to provide for independent operation of each discharge space. Continuous heating of the cathode makes it possible to ignite each discharge arc independently from the other two discharge arcs, whether there will be different phosphors in different discharge spaces or not. It is readily apparent that in the presence of a continuously heated cathode the time of response of each discharge within the light source unit to the ignition pulse will be shorter as compared with a situation in which individual cathodes are present for each discharge space and should be heated not before ignition thereof is intended. In addition thereto, only two passages for the lead-ins are necessary instead of six in the case of three cathodes being present. Further, only one exhaust tube and only one exhaust procedure are necessary instead of three. These facts represent further advantages of the invention.

Unipolar operation is preferred, notwithstanding that there is no denying the fact that also bipolar operation is possible, using electrodes at both ends of the arc length instead of cathode and anode. In case of unipolar operation anodes being plates or conductive coatings inside the envelope are preferred.

BRIEF DESCRIPTION OF THE DRAWINGS

The invention and its preferred embodiments are described in more detail in view of the accompanying drawings:

FIG. 29 is a section along the line A—A in FIG. 30;

FIG. 30 corresponds to FIG. 25 on a larger scale;

FIG. 31 is a section along the line B—B in FIG. 30; and

BEST MODE FOR CARRYING OUT THE INVENTION

Figure 1:
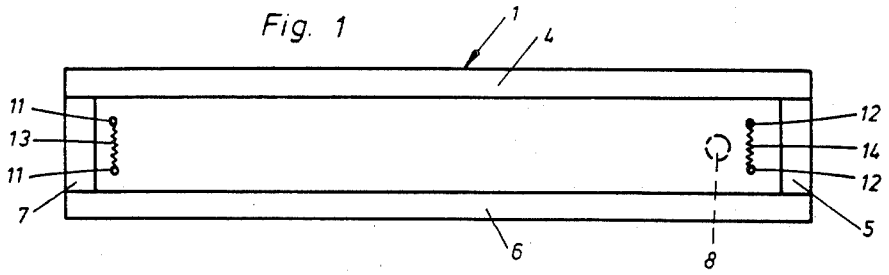
FIG. 1 is a plan view of a first embodiment of the invention.
Figure 2:
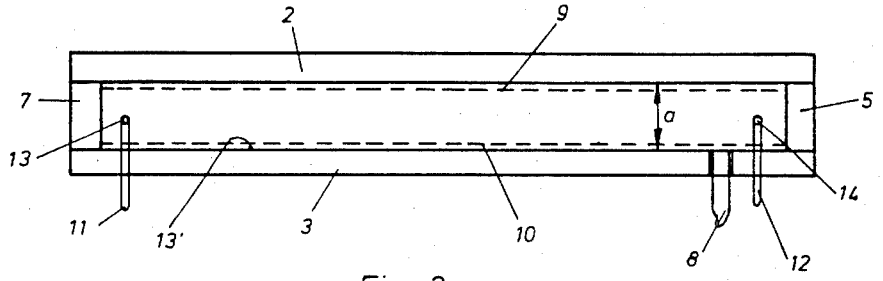
FIG. 2 is an elevational view of the first embodiment.

FIGS. 1 and 2 show a low pressure are discharge light source unit for bipolar operation comprising a vacuum-tight glass envelope 1 which is in accordance with the invention flat and essentially two dimentional and comprises two planar areas essentially parallel to each other at a small distance a. In this embodiment the envelope 1 comprises two planar bodies 2 and 3 off glass being fixed to each other by spacers 4, 5, 6 and 7 and glass solder (not shown). As to be seen from FIG. 1, the spacers 4, 5, 6 and 7 form a rectangular spacer frame to which the glass bodies 2, 3 are soldered. The rectangular spacer frame could be formed also unitary or as a one-piece-configuration, respectively.

Figure 3:
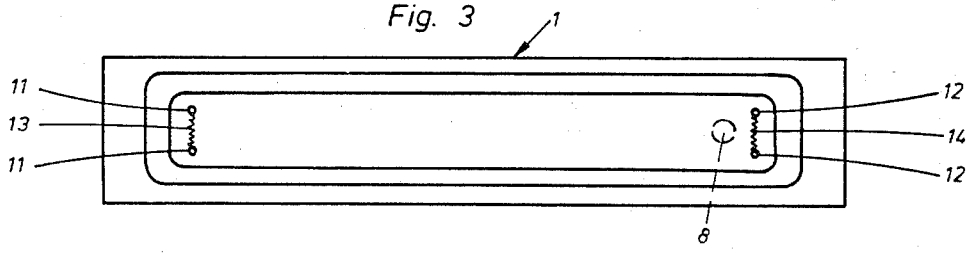
FIG. 3 is a plan view of a second embodiment.
Figure 4:
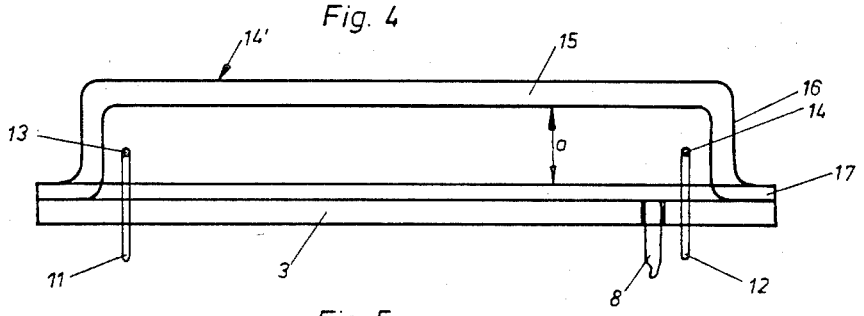
FIG. 4 is an elevational view of the second embodiment.

The low-temperature glass solder or frit, respectively, produces a vacuum-tight fit. An exhaust tube 8 (FIG. 2) allows the unit to be exhausted and filled with an inert fill gas and a quantity or drop, respectively, of mercury. Coatings 9 and 10 of fluorescent phosphor are provided on the inner side of the envelope or on the inner sides of the two planar glass bodies 2, 3, respectively. It is to be understood that when using the unit for display purposes it is advisable to provide for a reflective layer on the glass body adjacent to the display panel (not shown) which body is preferably body 3 to which lead-in wires 11 and 12 extend from the exterior towards electrodes 13 and 14. The lead-in wires 11 and 12, of course, pass through glass body 3 in a sealed- or melted-in manner. A reflective layer (not shown) could be disposed between the inner surface 13' of glass body 3 and coating 10, however, application of a reflective layer on the outside is possible also. As shown in FIGS. 1 and 2 the electrodes are provided for bipolar operation. The same kind of electrodes 13 and 14 is used with the embodiment according to FIGS. 3 and 4 and so the same numerals are used also for the lead-in wires 11 and 12 and for the planar glass body 3. The only difference of this embodiment as compared with the embodiment of FIGS. 1 and 2 resides in the facts that instead of the second planar glass body a trough-shaped glass body 14', a cover glass, is used, disposing of the frame forming spacers which are necessary with the preceding embodiment. In the embodiment of FIGS. 3 and 4 the trough-shaped glass body 14' comprises not only a planar area 15 and a rim 16, the latter being sufficient for forming a bond or joint with the planar glass body 3 by means of glass solder, but also a flange 17 for providing a broader surface of contact between bodies 14' and 3.

Figure 5:
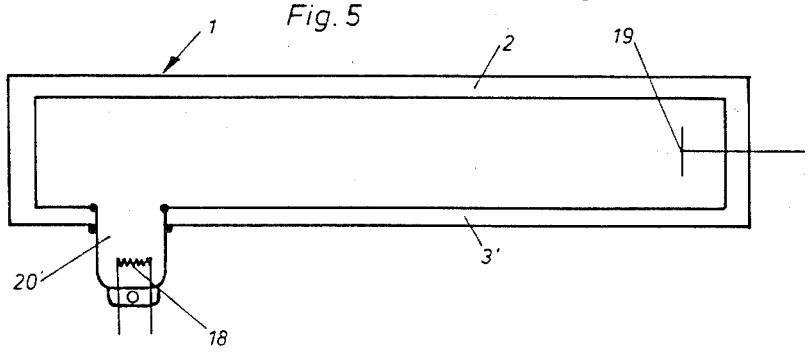
FIG. 5 is an elevational view of a third embodiment.

The embodiment according to FIG. 5 is a light source unit for unipolar operation using a cathode 18 and an anode 19. The rest of the construction is like the embodiment of FIGS. 1 and 2, except for a recessed space 20 for cathode 18 extending outwardly from the bottom of planar glass body 3'. The advantages of this configuration have been elucidated above already. It is to be understood that instead of planar glass body 2 a cover glass corresponding to the embodiment in accordance with FIGS. 3 and 4 can be used.

Figure 6:
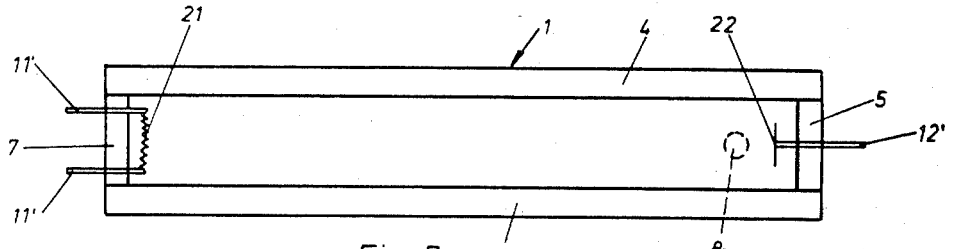
FIG. 6 is a plan view of a fourth embodiment.
Figure 7:
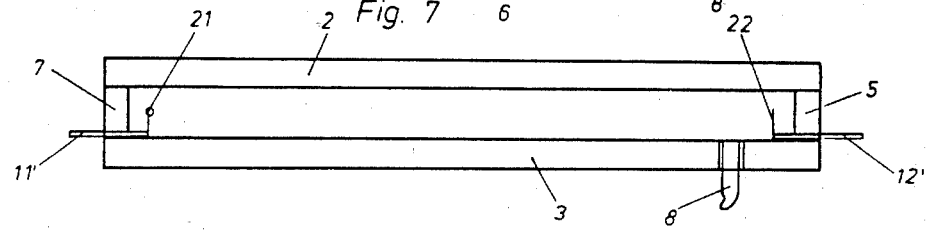
FIG. 7 is an elevational view of the fourth embodiment.

The embodiment of FIGS. 6 and 7 corresponds to the embodiment of FIGS. 1 and 2 except for the fact that it is destined for unipolar operation and, therefore, comprises a cathode 21 and an anode 22 instead of identical electrodes. Further, thin ribbons 11' and 12' are used as electrical conductors instead of wires.

Figure 8:
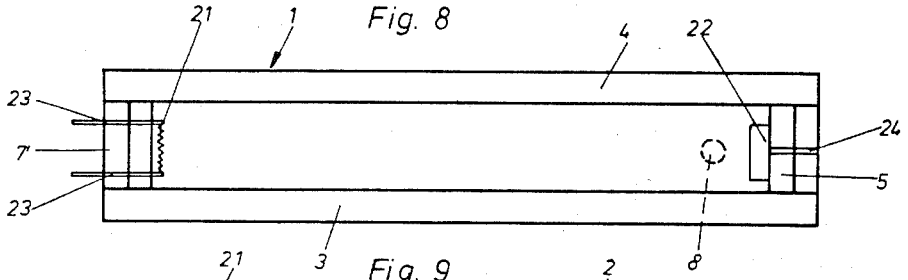
FIG. 8 is a plan view of a fifth embodiment.
Figure 9:
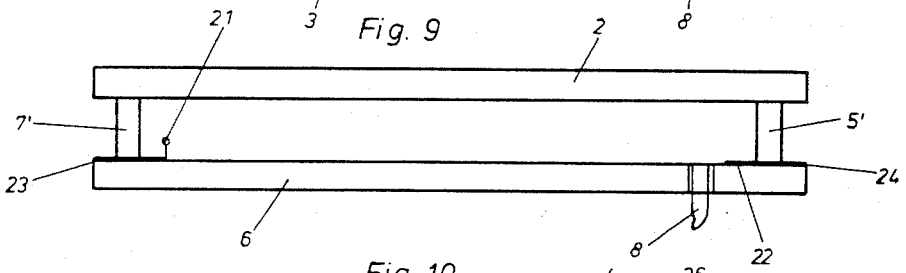
FIG. 9 is an elevational view of the fifth embodiment.

The embodiment of FIGS. 8 and 9 corresponds to the embodiment of FIGS. 6 and 7 except for the realization of the electrical conductors and spacers 5 and 7. The electrical conductors are layers 23 and 24 in thick or thin film technique out of metal or graphite, not only for the leads of the anode 22, the latter forming a film layer inside of spacer 5'.

In the embodiment of FIGS. 8 and 9, the planar glass bodies 2 and 3 extend beyond the two spacers 5' and 7' of spacer frame 4, 5', 6, 7' so that there will be areas of the electrical conductor layers 23 and 24 being exposed to the outside of unit 1 so that contact can be made as desired, planar glass body 3 forming at its end a substrate for such connecting ends of the layers.

It is preferred to provide for anodes of large areas. The electrodes and/or the cathodes can be oxide-coated tungsten filaments.

Figure 10:
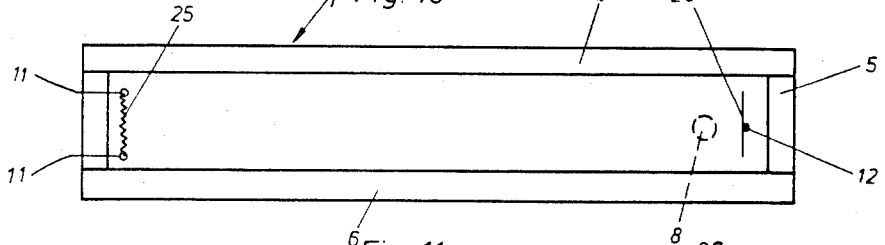
FIG. 10 is a plan view of a sixth embodiment.
Figure 11:
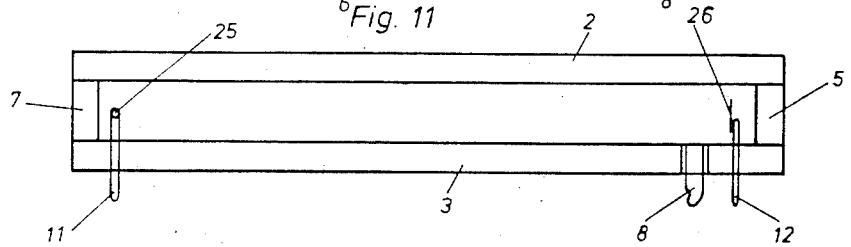
FIG. 11 is an elevational view of the sixth embodiment.

The embodiment of FIGS. 10 and 11 corresponds to the embodiment of FIGS. 1 and 2 except for the unipolar configuration, i.e., it has a cathode 25 and an anode 26 instead of identical electrodes, anode 26 corresponding essentially to anode 22 of the embodiment of FIGS. 6 and 7, except for the electrical connectors which are not ribbon-like but lead-in wires or pins as it is the case with the embodiment of FIGS. 1 and 2. Again to the same parts the same reference numerals have been assigned.

FIGS. 12 to 28 present a collection of possible modifications of the inventive principle offered by means of example. It is to be understood that the variations possible are virtually infinite. The variation includes not only the method of electrical operation (unipolar and bipolar) but also the number of emitted colors and the length of the arc or arcs within one unit. With the shown embodiments the electrical connectors are situated in accordance with the embodiments of FIGS. 6, 7 and 8, 9, respectively, i.e., the connectors are ribbons 11', 12' or layers 23, 24. In all these further embodiments, reference numerals used in previous embodiments are used also here for identical parts if not otherwise indicated.

For display purposes the devices or units, respectively, are generally single-ended at the rear as it is the case with the embodiments of FIGS. 1, 2 and 3, 4 and 10, 11. The arcs and their lengths are shown by dotted lines.

Figure 12:
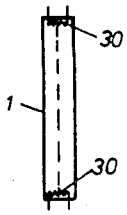
FIG. 12 to FIG. 28 are plan views of further embodiments.

FIG. 12 is a monochrome unit for bipolar (A.C.) operation having two electrodes and simple arc length.

Figure 13:
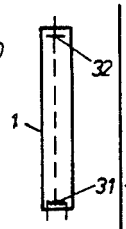

FIG. 13 is a monochrome unit for unipolar (D.C.) operation having a cathode 31 and an anode 32 and simple arc length.

Figure 14:
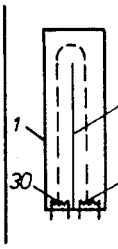

FIG. 14 is a monochrome unit for bipolar operation at double arc length comprising a separating wall 28 separating the two electrodes 30, however, keeping a distance b from the opposite end of the unit so that the arc will turn around free end 32 of wall 28 and its length will be twice as long as with the embodiments in accordance with FIGS. 12 and 13.

The embodiments in accordance with FIGS. 14 to 28 all have at least one separating wall 27 or 28 within the envelope. Separating wall 27 extends at both ends up to and sealingly joins with the spacer frame 4, 5, 6, 7 or the rim or the rims 16 and throughout its edge length with the glass bodies of the envelope to form different discharge spaces as will be further described in view of FIGS. 18, 20, 23, 24, 26 and 28. The different discharge spaces can be provided or coated, respectively, with fluorescent phosphors of different spectral power distribution to provide different colors. The other kind of separating wall is a partially separating wall 28 within an envelope 1 which extends up to and joins with the spacer frame 4, 5, 6, 7 or the rim or the rims 16 of envelopes 1 with only one end thereof and, of course, throughout its edge length with the respective glass bodies of the envelope, whereas the other end keeps the distance b (FIG. 14) from the spacer or the rim or the rims in order to provide for discharge spaces allowing a common cathode. Multiple arc length has already been mentioned in view of FIGS. 14 and 15 and will also be shown in view of FIGS. 16, 17, FIGS. 19 to 22 and FIGS. 25 to 28. Discharge spaces allowing a common cathode 29 will be described in view of FIGS. 19, 22, 25 and 27.

Figure 16:
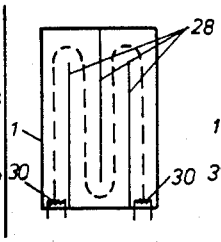

FIG. 16 is a bipolar monochrome unit having quadruple arc length provided by three partially separating walls 28 arranged in an opposed manner for providing a zig-zag-configuration of the arc.

Figure 17:
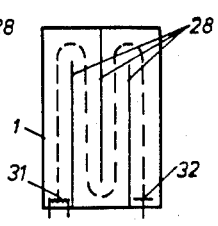

FIG. 17 corresponds to FIG. 16, however, is destined for unipolar operation and, therefore, equipped not only with a cathode 31 but also with an anode 32.

Figure 18:
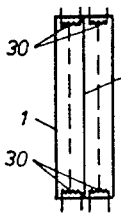

FIG. 18 is a bipolar two color unit having two different discharge spaces separated by wall 27.

Figure 19:
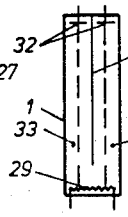

FIG. 19 is a unipolar two color unit having also two different discharge spaces and two anodes 32, however, in view of partially separating wall 28 a common cathode 29 can be provided. It is to be understood that in spite of the common cathode 9 both discharge spaces 33 and 34 can be ignited and controlled independently from each other so that the unit can switch over from one color to the other notwithstanding the fact that in doing so not only different discharge spaces but also different phosphors are involved. By the way, this embodiment can provide, of course, for the impression of three colors at the spectator by using only discharge space 33 or discharge space 34 or both. Further, also a monochrome configuration is possible providing for different brightness of one and the same color depending from whether only one discharge space is used or both. What is more, switching operation is accomplished at a shorter time in view of the fact that the cathode 29 serves two (or possibly more, please see the embodiment in accordance with FIG. 25) anodes 32.

Figure 15:
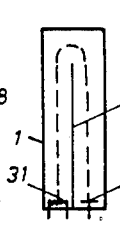
Figure 20:
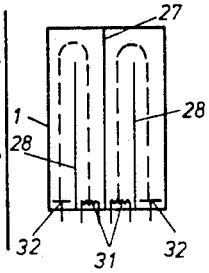

FIG. 20 is a unipolar two color unit representing practically a duplication of the embodiment in accordance with FIG. 15.

Figure 21:
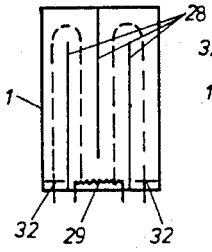

FIG. 21 corresponds to FIG. 20 except for having a centrally arranged partially separating wall 28 (instead of an entirely separating wall 27 in FIG. 20) and, therefore, this unipolar two color unit can use a single and common cathode 29 providing for a quicker response. Whereas the embodiments in accordance with FIG. 18 and FIG. 19 show simple arc length, the embodiments in accordance with FIGS. 20 and 21 show doubled arc length and, therefore, double brightness of the radiation emitted.

Figure 22:
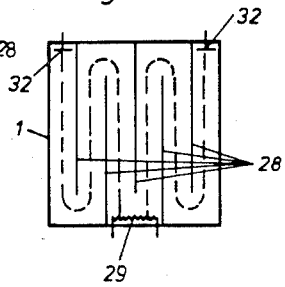

FIG. 22 showing a unipolar two color unit provides for triple arc length and, therefore, accordingly further enhances brightness.

Figure 23:
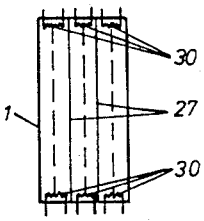

FIG. 23 is a bipolar three color unit, a so-called "pixel" at simple arc lengths.

Figure 24:
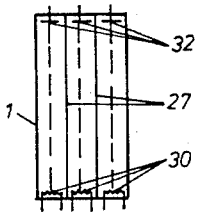

FIG. 24 is a unipolar three color unit, also a pixel, and is shown in FIGS. 29, 30 and 31 in more detail.

Figure 25:
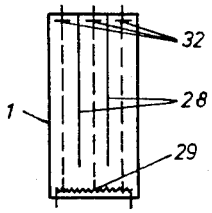

FIG. 25 is a unipolar three color pixel having a common cathode 29.

Also the embodiments according to FIGS. 24 and 25 have simple arc length.

Figure 26:
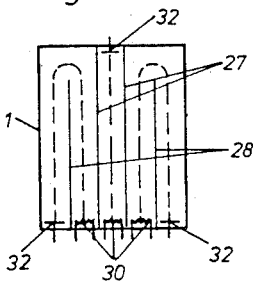
Figure 27:
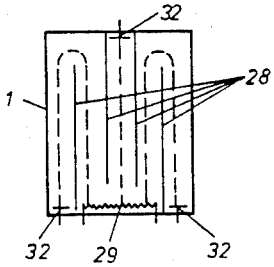

FIG. 26 is a unipolar three color unit having the two outer discharge spaces at double arc length and the middle discharge space at normal, i.e., simple arc length. Same applies to the embodiment in accordance with FIG. 27, however, in this case a common cathode 29 is provided for serving all the three discharge spaces formed by partially separating walls 28. In FIG. 26, of course, the middle discharge space having only half the length of the outer discharge spaces is fenced in by separating walls 27 extending at both ends up to and sealingly joining with the rim of the unit leaving no distance. In both cases the color green having the highest electro-optical efficiency will be chosen for the middle discharge space in order to compensate for the different brightness caused by different arc lengths.

Figure 28:
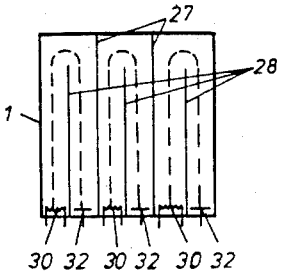
Figure 32:
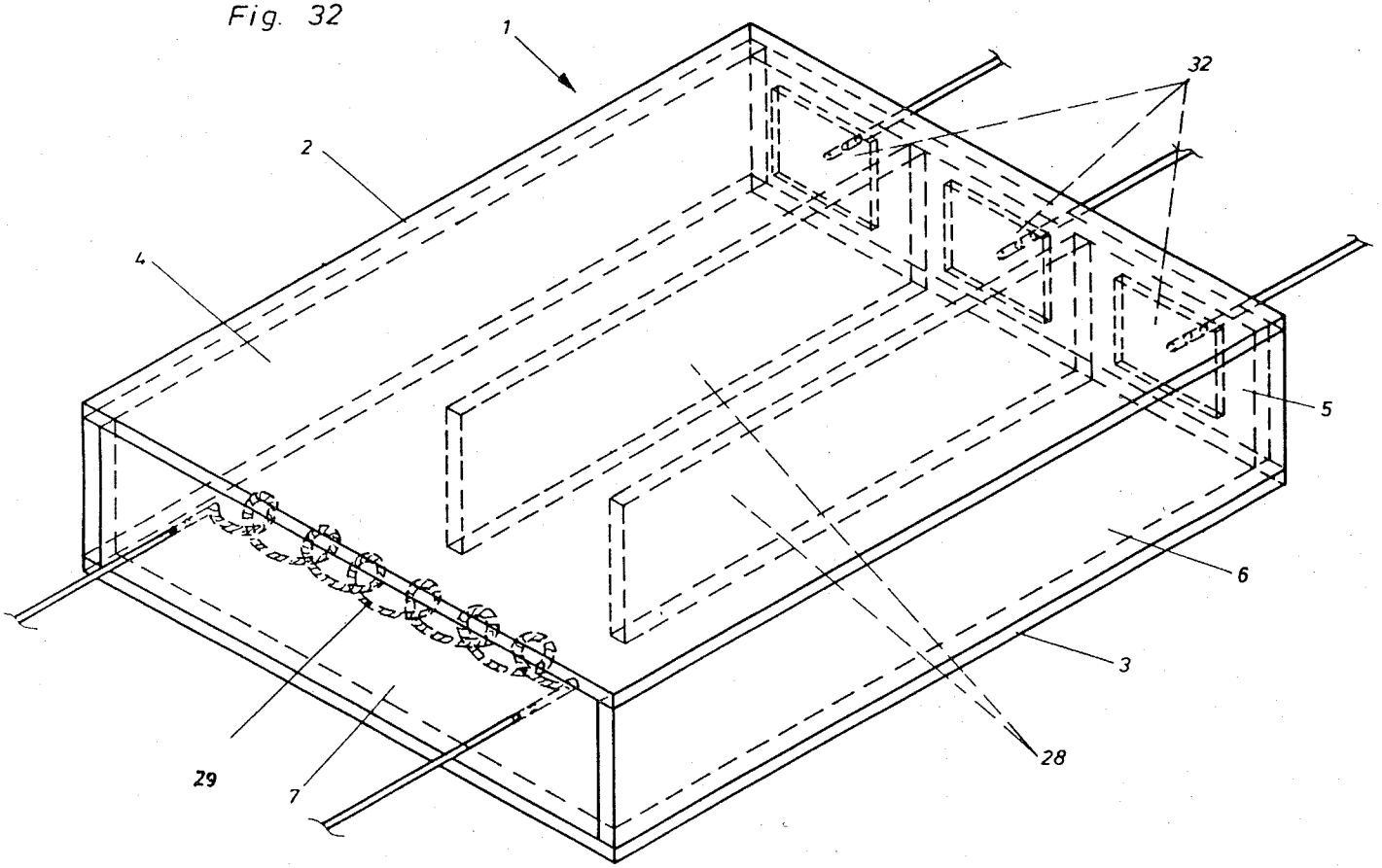
FIG. 32 is a perspective view of the embodiment in accordance with FIGS. 25, 29, 30 and 31 on a further enlarged scale.

FIG. 28 is a unipolar pixel with double arc lengths for all the three colors.

It is to be understood that in every modification chosen for a special display application the longest possible arc length or path in order to achieve maximum efficiency should be chosen.

In separating the discharge spaces always glass can be used, however, in case of multicolor devices dark glass is to be preferred in order to avoid color mixing. Attention has been drawn already to the fact that color mixing or the formation of different colors not being plainly red, green and blue, respectively, is to be carried out by the human eye/brain system.

Application of the inventive light source unit for display purposes requires extensive brightness control. This can be achieved by unipolar operation of the D.C. configuration and by controlling the current and/or pulse width in a pulse modulation system.

To obtain maximum electro-optical conversion efficacy it is important to use an optimum temperature to produce an optimum mercury vapour pressure. With the unit in accordance with the invention this can be achieved by thermostatic control of a thermal conductive metallic flange to be arranged at the backside of the unit, i.e., the side at which the unit will be affixed to a display panel or the like. Good thermal conductivity may be obtained by the use of e.g., alumina filled adhesive or silicone grease.

In order to keep power losses due to cathode and anode fall as low as possible, it is essential to maintain the gas discharge at as high an arc voltage as possible. Also this can be achieved by means of long arc paths which can be contained by the separating or partitioning, respectively, walls 28 as described in more detail above. Special attention is drawn to the advantages single-ended units obtained by this technique in accordance with FIGS. 14 to 17, 20, 21 and 28 have. As pointed out above, the general shape of the light source units in accordance with the invention does not necessarily have to be rectangular or square, the shape could also be circular or polygonal. Accordingly, also the separating walls do not necessarily have to be planar, e.g., in case of a circular shape of the unit, the wall may take the form of an archimedic spiral.

It should be understood that reflective coatings are advantageous with uni-directional displays; bi-directional displays do not need reflective layers, of course. If reflective material is used, this can be metals if the reflective coating is deposited on the outer surface of the envelope, e.g., Ag, Al and Cr, or white pigments, e.g., alumina, barium sulphate or magnesia if used inside the envelope. As pointed out previously, also the reflective layer can be coated with a fluorescent phosphor if arranged inside the envelope.

Emphasis is given to the advantage residing with the invention with regard to the fact that the forming of the envelope including the separating walls and the electrodes or cathodes and anodes, including the appertaining electrical conductors, can be accomplished by one and the same manufacturing step in the furnace, preferably feed belt furnace.

The unipolar three color pixel, in accordance with FIGS. 25, 29, 30, 32 and 32, seems to be the most interesting embodiment under practical aspects. As elucidated above, the common cathode 29 which in operation will be heated constantly will provide for an easy and quick response to ignition and instantaneous fluorescence of the three colors in common. In addition thereto, it is possible to ignite each discharge arc independently from the other two discharge arcs, whether there will be different phosphors in different discharge spaces or not. Only one exhaust tube and only one exhaust procedure are necessary with the embodiment in accordance to the said Figures, notwithstanding the fact that an exhaust tube is not shown therein. Attention is invited to the preamble of the present specification, page 7, paragraph 2 where the advantages of an embodiment in accordance with FIGS. 25 and 29 to 32 are elucidated.

It is to be understood that the invention is not limited to pixels or units having only three discharge spaces, respectively. It was pointed out above that the number of possible embodiments is virtually indefinite and that, e.g., four, five, six or more discharge spaces, whether providing for different colors or not, can be incorporated within one and the same envelope enclosing the necessary number of separating walls and electrodes. The concept of only one cathode opposing a multiplicity of anodes is emphasized again.

I claim:

1. A low pressure arc discharge light source unit for unipolar or bipolar operation comprising a vacuum-tight flat essentially two-dimensional glass envelope having two planar areas essentially parallel to each other at a predetermined distance and having two opposing ends, said envelope being translucent at at least one side thereof, a rare fill gas and a quantity of mercury therein, at least three electrodes opposed to each other within the envelope and connected to electrical conductors, at least two parallel separating walls within the envelope located between the planar areas with at least one of the separating walls having a pair of ends with one end thereof extending up to and joining with one of the opposing ends of the envelope and the other end thereof being separated from the other opposing end of the envelope such that at least two discharge spaces are provided with one of the discharge spaces having a multiple arc length, and a fluorescent coating disposed on the inner side of the envelope and including at least two fluorescent phosphors of different spectral power distribution, each of the discharge spaces being coated with a different fluorescent phosphor.

2. The light source unit according to claim 1 wherein the envelope comprises two planar bodies of glass being fixed to each other by spacers and glass solder.

3. The light source unit according to claim 1 wherein the envelope comprises a planar glass body and a trough-shaped glass body having a planar area and a rim, both bodies bonded to each other along the rim of the trough-shaped body by glass solder.

4. The light source unit according to claim 1 wherein the envelope comprises two trough-shaped glass bodies having planar areas and rims, both bodies bonded together along their rims by glass solder.

5. The light source unit according to claims 1, 2, 3 or 4 wherein there is a distance of approximately 3 mm to 10 mm between planar bodies or a planar body and the planar area of a trough-shaped body or the planar areas of two trough-shaped bodies.

6. The light source unit according to claim 1 wherein on at least one of the inner sides of the planar areas there is a fluorescent phosphor coating whereas on the inner or outer side of the opposite planar area there is a reflective coating.

7. The light source unit according to claim 1 wherein at least one separating wall within the envelope extends at both ends up to and sealingly joins with the opposing ends of the envelope.

8. The light source unit according to claim 1 wherein each of the discharge spaces is formed by walls extending up to and joining with an opposing end of the envelope with only one end thereof whereas the other end keeps a distance from the other opposinge end, a common cathode is arranged within said distance serving each of the discharge spaces.

9. The light source unit according to claim 1 for unipolar operation wherein a recessed space for the cathode is provided.

10. The light source unit according to claim 1 wherein for unipolar operation the anode of each discharge space is a plate or a conductive coating inside the envelope.

11. The light source unit of claim 1 wherein a plurality of discharge spaces having a multiple arc length is provided, at least one of said discharge spaces having a multiple arc length being different from the multiple arc lengths of the other discharge spaces present.

12. The light source unit of claim 1 wherein all the discharge spaces are formed by walls having one end extending up to and joining with an opposing end of the envelope, the other end keeps a distance from the other of the opposing ends, one common cathode is arranged within said distance serving all the discharge spaces present.

* * * * *